US009765605B2

(12) United States Patent
Williamson et al.

(10) Patent No.: US 9,765,605 B2
(45) Date of Patent: Sep. 19, 2017

(54) RE-FRACTURE APPARATUS AND METHOD FOR WELLBORE

(71) Applicant: Weatherford/Lamb, Inc., Houston, TX (US)

(72) Inventors: Scott Williamson, Castle Rock, CO (US); Cornelis C. Valkenburg, Powell, WY (US)

(73) Assignee: Weatherford Technology Holdings, LLC, Houston, TX (US)

( * ) Notice: Subject to any disclaimer, the term of this patent is extended or adjusted under 35 U.S.C. 154(b) by 231 days.

(21) Appl. No.: 14/522,960

(22) Filed: Oct. 24, 2014

(65) Prior Publication Data

US 2015/0114639 A1 Apr. 30, 2015

Related U.S. Application Data

(60) Provisional application No. 61/895,858, filed on Oct. 25, 2013.

(51) Int. Cl.
*E21B 33/124* (2006.01)
*E21B 43/16* (2006.01)
(Continued)

(52) U.S. Cl.
CPC ..... *E21B 43/16* (2013.01); *E21B 33/124* (2013.01); *E21B 33/1208* (2013.01);
(Continued)

(58) Field of Classification Search
CPC .... E21B 33/1208; E21B 34/14; E21B 33/124; E21B 43/114; E21B 43/14; E21B 43/16;
(Continued)

(56) References Cited

U.S. PATENT DOCUMENTS 2,761,748 A * 9/1956 Marien ..... F16J 9/067 277/488
3,396,798 A 8/1968 Burns
(Continued)

FOREIGN PATENT DOCUMENTS

EP 2372080 A2 10/2011
EP 2436874 A1 4/2012

OTHER PUBLICATIONS

International Search Report and Written Opinion in counterpart PCT Appl. PCT/US2014/062127; mailed Jun. 2, 2015; pp. 1-6.
(Continued)

*Primary Examiner* — Taras P Bemko
(74) *Attorney, Agent, or Firm* — Blank Rome LLP

(57) ABSTRACT

Re-treatment of a formation having a wellbore, which can be an open hole or a cased hole lined with casing, involves deploying a tubing string in the casing having tools disposed at intervals thereon. The tools position on the tubing string, and the tubing string with the tools thereon is inserted into the casing. Biasing rings of the tools passively engage with the casing. The annulus is accessed between the tubing string and the casing at the intervals between the tools. For example, sliding sleeves on the tubing string can be opened (selectively), or new plug and perforation operations can be used to create perforations in the tubing string at desired intervals between the tools. With access achieved, retreatment is pumped down the tubing string, out the access to the annulus, and at least partially sealed by the engaged rings in the intervals between the tools.

21 Claims, 7 Drawing Sheets

(51) Int. Cl.

| | |
|---|---|
| ***E21B 34/14*** | (2006.01) |
| ***E21B 43/114*** | (2006.01) |
| ***E21B 43/24*** | (2006.01) |
| ***E21B 43/26*** | (2006.01) |
| ***E21B 43/267*** | (2006.01) |
| ***E21B 33/12*** | (2006.01) |
| ***E21B 43/14*** | (2006.01) |
| *E21B 34/00* | (2006.01) |

(52) U.S. Cl.
CPC ..... *E21B 34/14* (2013.01); *E21B 43/114* (2013.01); *E21B 43/14* (2013.01); *E21B 43/24* (2013.01); *E21B 43/26* (2013.01); *E21B 43/267* (2013.01); *E21B 2034/007* (2013.01)

(58) Field of Classification Search
CPC ..... E21B 43/24; E21B 43/26; E21B 43/267; E21B 2034/007
USPC ..... 166/244.1, 191, 308.1, 303, 307, 298
See application file for complete search history.

(56) References Cited

U.S. PATENT DOCUMENTS

| | | | | |
|---|---|---|---|---|
| 3,861,465 | A | 1/1975 | Mignotte | |
| 5,161,612 | A | 11/1992 | Stafford | |
| 5,303,774 | A | 4/1994 | Duhn et al. | |
| 5,803,178 | A * | 9/1998 | Cain | E21B 33/124 166/306 |
| 6,315,041 | B1 | 11/2001 | Carlisle | |
| 2011/0240311 | A1* | 10/2011 | Robison | E21B 23/04 166/373 |

OTHER PUBLICATIONS

Speirs, A.B., et al., "Improving Production in Steamed Wells with a Ring Seal Packer," SPE 29632, SPE Western Regional Meeting, Mar. 8-10, 1995.

Lombard, M.S., et al. "Field Trials Using an All Metal Ring Seal Floating Packer," SPE 113981, 2012 SPE Western Regional Meeting, Mar. 21-23, 2012.

Oil Gas Innovation, "Completions Packer Assemblies: Model TS Thermal Ring Seal," Brochure, undated, obtained on Oct. 24, 2014 from http://www.oilgasinnovation.com/PDF/LINER%20COMPLETION/MODEL%20TS%20THERMAL%20RING%20SEAL.pdf.

Weatherford, "Packers Catalog," Brochure 667.03, copyright 2005-2010.

* cited by examiner

RE-FRACTURE APPARATUS AND METHOD FOR WELLBORE

CROSS-REFERENCE TO RELATED APPLICATIONS

This application claims the benefit of U.S. Prov. Appl. 61/895,858, filed 25 Oct. 2013, which is incorporated herein by reference.

BACKGROUND OF THE DISCLOSURE

A number of techniques can be used to complete a well and prepare it for production. For example, a borehole may have casing cemented therein. To prepare the borehole for production, operators perform a plug and perforation operation. To do this, a jetting tool and a milling tool are run on coil tubing into the cemented casing to clean out residual cement. The jetting tool is then used to initially perforate the casing at the toe of the borehole.

Once these initial perforations are formed, a wireline-deployed perforating gun and a bridge plug are pumped down the casing. The bridge plug is set in the casing to isolate the lower zone of the borehole, and the perforating gun perforates the casing. The wireline is removed from the borehole, and fracture treatment is pumped down the casing to fracture the zone at the perforations in the casing. This operation of pumping down a plug, perforating the casing, and pumping fracture treatment is then repeated multiple times up the borehole until a desired number of zones in the formation have been fractured. In final stages, the bridge plugs can be milled out of the casing using a milling tool.

Although such operations may successfully prepare a well for production, there may be a need at some point in the life of the well to re-fracture the existing borehole even though the borehole was originally completed and hydraulically fractured using the plug and perforation operation. To perform the re-fracture operation, a traditional zonal pressure isolation system, generally consisting of smaller tubing mounted with packers and fracture sleeves, can be inserted into the existing casing so various zones can be re-fractured.

For example, FIG. 1 shows a wellbore 10 having cemented casing 12 and perforations 14. This wellbore 10 may have been initially fractured using plug and perforation operations. To re-fracture zones, a wellbore system 20 having an inner tubing string 22 is deployed in the casing 12 from a rig 24. The tubing string 22 has various sliding sleeves 30 and packers 40 disposed along its length at particular zones to be re-fractured. The packers 40 are set inside the casing 12 to isolate the wellbore annulus 16 into isolated zones.

The sliding sleeves 30 deployed on the tubing string 22 between the packers 40 can be used to divert treatment fluid to the isolated zones of the surrounding formation through the casing's perforations 14. As conventionally done, operators rig up fracturing surface equipment 26 for pumping fluid down the tubing string 22. In stages of operation, operators then deploy specifically sized balls to open the sliding sleeves 30 between the packers 40 and to divert fracture treatment to each of the isolated zones up the wellbore 10.

Historically, the packers 40 used for zonal isolation in the re-fracture operations have elastomeric packing elements, such as swellable elements, cup packers, or hydraulically compressed packing elements. As can be seen, such a traditional isolation system 20 has a restricted inner dimension because the tubing string 22 must have a dimension capable of fitting in the casing 12. Additionally, the tubing string 22 must be dimensioned so that the sliding sleeves 30 and the packers 40 deployed on the string 22 can operate properly in the available annulus 16 between the tubing string 22 and the existing casing 12. The restricted inner dimension of the tubing string 22 caused by these requirements may make the system 20 unacceptable for use at high fracture injection rates.

One alternative way to perform a re-fracture operation can use a larger internal tubing string that installs in the existing casing 12. This larger tubing string allows a secondary plug and perforation operation to be performed in the wellbore 10. As expected, the annular space between the outer dimension of such a larger internal string and the inner dimension of the existing casing 12 is very limited, and this limited dimension makes isolating the zones along the borehole difficult to achieve. In fact, there may be insufficient room to create a suitable seal between the tubing string and the casing 12 that the objective of zonal isolation cannot be achieved for the new plug and perforation operation. The small annular gap might be an application where swellable elastomers could be used. However, there may be no activation fluid available in low fluid level wells for the swellable elastomer to function properly.

Another alternative way to perform a re-fracture operation can use a large diameter tubing string inserted into the existing casing 12 to tightly fit in the casing 12. It is believed that the tight fit between the inner and outer strings diverts the fracture treatment fluid albeit without a seal. One other solution includes mechanically deforming a tubular against the inner dimension of the casing 12 to create the desired zonal isolation, but such systems are very expensive and difficult to implement. Lastly, chemical/cement squeezes have been used for re-fracture operations, but these methods tend be unsatisfactory for pressure integrity and are likewise expensive.

The subject matter of the present disclosure is directed to overcoming, or at least reducing the effects of, one or more of the problems set forth above.

SUMMARY OF THE DISCLOSURE

A re-fracture apparatus according to the present disclosure uses diversion or isolation tools disposed on a tubing string inserted in a wellbore, which can be an open hole borehole or can be lined with casing. This existing casing may have been previously perforated with a plug and perforation operation so that various zones along the wellbore can be hydraulically fractured. To re-fracture the formation's zones, the tubing string with the tools installs in the borehole or casing. The tubing string may include a number of sliding sleeves that can be selectively opened using setting balls or plugs to communicate treatment fluid with the surrounding formation through adjacent perforations. Alternatively, the tubing string may be subjected to new plug and perforation operations at selected intervals.

The tubing string may have an outer dimension that is close to the inner dimension of the borehole or outer casing, which allows the tubing string to convey more fracture fluid during the re-fracture treatment at higher pressures. To seal the various zones of the wellbore from one another along the length of the tubing string, the tools disposed between the sliding sleeves or tubing string intervals each has one or more split rings for sealing (at least partially) against the inner dimension of the borehole or casing to prevent fluid flow out of a selected zone.

The one or more split rings can be movable (e.g., rotatable) on the tubular housing of the tool so that they can readily engage against the inner dimension of the borehole or casing. Being movable, it is possible for the various splits in the split rings to align and misalign relative to one another during use, which will allow at least some fluid flow in the annulus between the tubing string and the borehole or outer casing. The tortuous fluid path created by the split rings, however, inhibits flow in the annulus past the tool's rings so re-fracture treatment can still be concentrated in the zone of interest.

The foregoing summary is not intended to summarize each potential embodiment or every aspect of the present disclosure.

DETAILED DESCRIPTION OF THE DISCLOSURE

Figure 1:
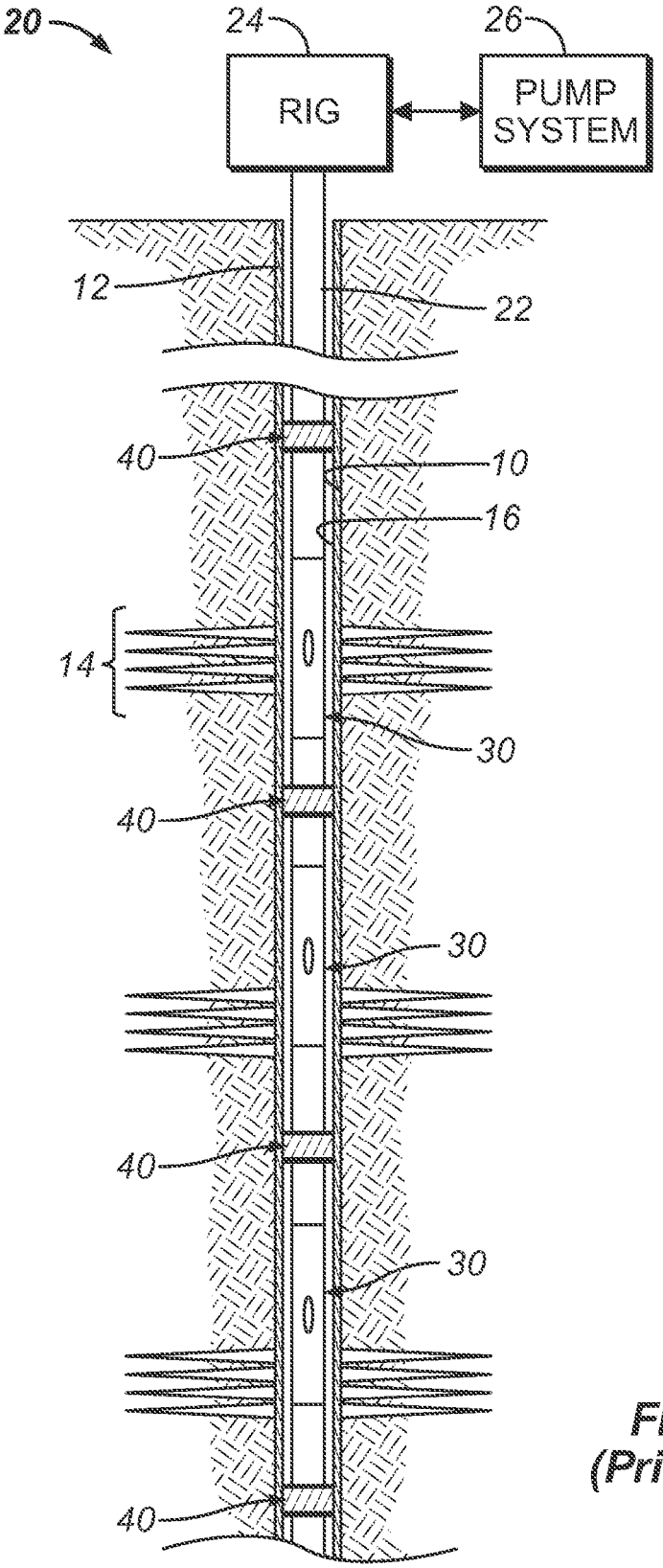
FIG. 1 (Prior Art)
FIG. 1 illustrates a prior art wellbore system for re-fracturing zones of a wellbore originally treated through a plug and perforation operation.
Figure 2A:
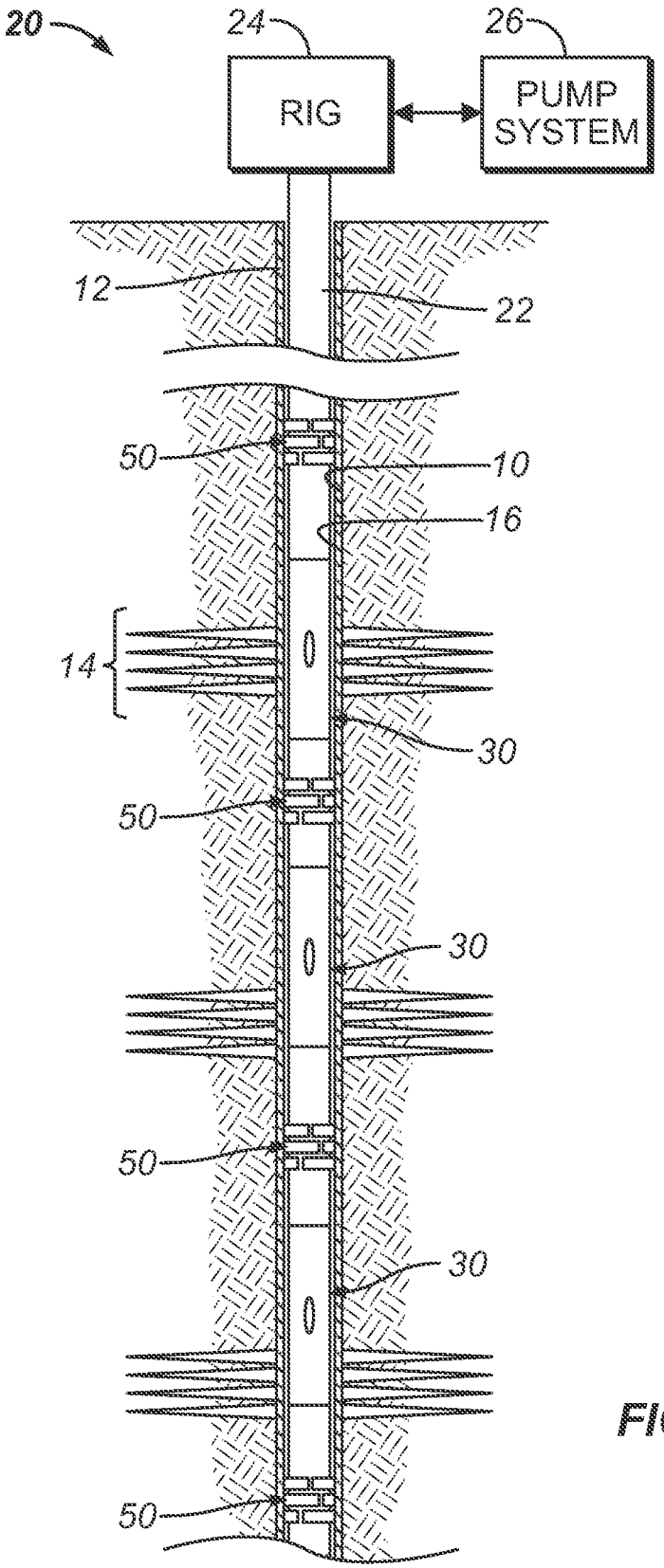
FIG. 2A illustrates a wellbore system according to the present disclosure for re-fracturing zones of a wellbore originally treated through a plug and perforation operation.
Figure 2B:
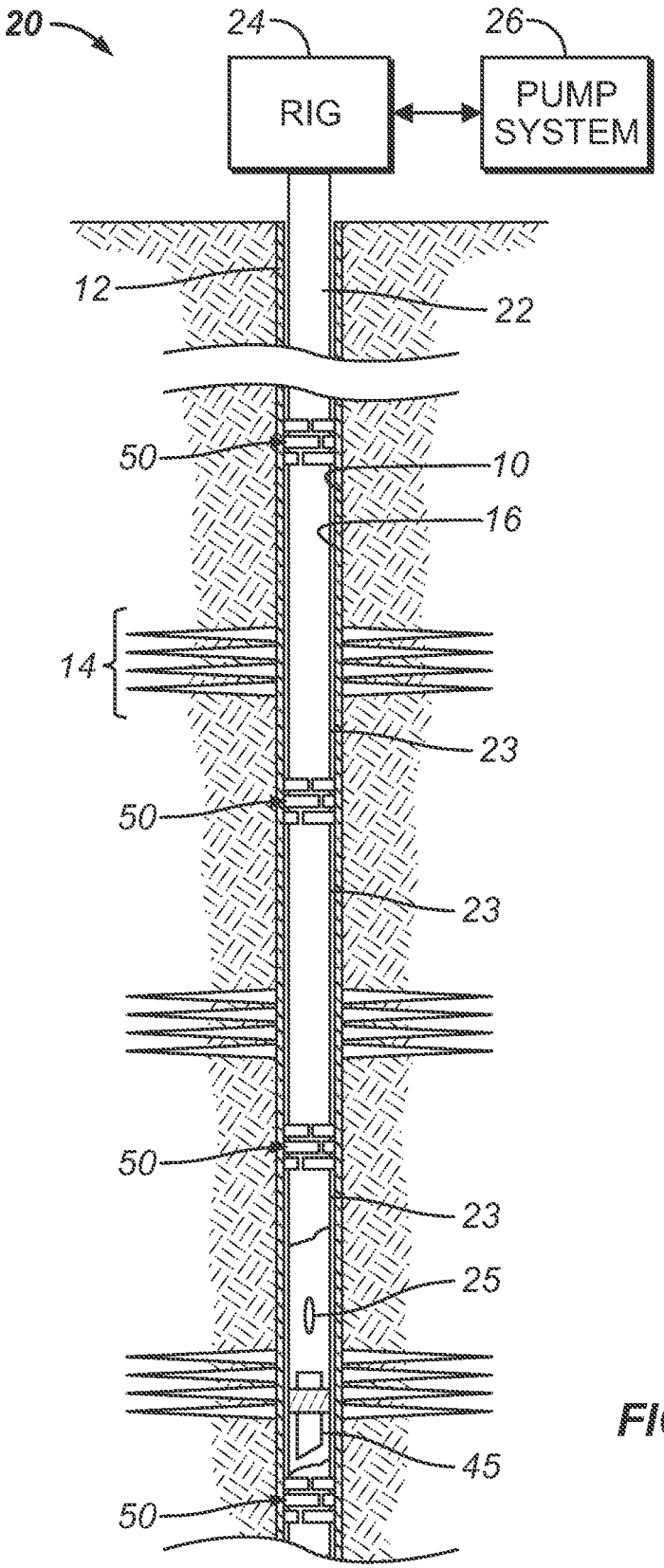
FIG. 2B illustrates another wellbore system according to the present disclosure for re-fracturing zones of the wellbore.

FIG. 2A illustrates wellbore systems 20 according to the present disclosure for re-fracturing zones of a wellbore 10 originally treated through a plug and perforation operation, although other types of wellbores 10 can be subjected to the re-fracturing or retreatment by the disclosed systems 20. The wellbore 10 can be an open hole borehole, or as shown, the wellbore 10 can have cemented casing 12 and perforations 14. The wellbore system 20 has an inner tubing string 22 deployed in the casing 12 from a rig 24. For the system 20 of FIG. 2A, the tubing string 22 has various sliding sleeves 30 disposed along its length at particular zones to be re-fractured. In FIG. 2B, the tubing string 22 has blank sections 23 of pipe where new plug and perforation operations can be performed to re-fracture the wellbore 10 at particular zones.

In contrast to prior systems, the tubing string 22 has an increased size so that the inner dimension of the tubing string 22 is larger in relation to the casing 12 and the annulus 16 is narrower. This allows the system 20 to accommodate greater flow rates and higher fracture pressures. Rather than using packers for zonal isolation between zones as in the prior art, the tubing string 22 has a number of retreatment/re-fracture isolation tools 50 disposed thereon to isolate the wellbore annulus 16 into the isolated zones. The re isolation tools 50 described in FIGS. 2A-2B may also straddle/isolate existing perforations in the casing and may allow new perforations to be added in various sections of the wellbore.

For the system 20 in FIG. 2A, the sliding sleeves 30 deployed on the tubing string 22 between the isolation tools 50 can be used to divert treatment fluid to the isolated zone of the surrounding formation through the casing's perforations 14. To perform the re-fracture operation, operators rig up fracturing surface equipment 26 for pumping fluid treatment down the tubing string 22. In stages of operation, operators then deploy specifically sized balls to actuate the sliding sleeves 30 between the isolation tools 50 and to divert fluid treatment to each of the isolated zones up the wellbore 10.

Alternatively, the system 20 in FIG. 2B can use new plug and perforation operations to divert treatment fluid to isolated zones. For example, a plug 45 can be deployed in the tubing string 22 to isolate downhole portions of the string 22, and a perforating gun (not shown) can create new perforations 25 in a blank section 23 between the isolation tools 50. After removing the perforating gun and deploying a setting ball on the plug 45, operators pump fluid treatment down the tubing string 22 to divert the treatment to the adjacent zone. This new plug and perforation operation can then be repeated up the tubing string 22.

Notably, the isolation tools 50 are configured to at least partially restrict flow in the annulus 16 between the tubing string 22 and the casing 12 so that the fluid treatment communicated out of a particular sliding sleeve 30 or adjacent perforations is primarily diverted to the adjacent isolated zone.

As shown in FIGS. 3A-3D, one configuration of the retreatment/re-fracture isolation tool 50 includes a tubular housing or mandrel 52 with first and second ends 54*a-b* for coupling to tubing components or other tools (e.g., sliding sleeve) on the system's tubing string. (The housing 52 may alternatively affix on the exterior of a pipe section or mandrel of the tubing string.) A bore 56 through the tubular housing 52 allows the tool 50 to conduct fluid treatment along the tubing string on which the tool 50 is used. The housing's ends 54*a-b* may be threaded with box and/or pin ends commonly used for coupling to tubing components or other tools.

The overall length of the tubular housing 52 can depend on the implementation, but may in some cases be about 6-inches. The length (L) can be greater to accommodate tongs for installing the tool 50 on tubing during deployment. The overall diameter (D) of the tubular housing 52 can also depend on the implementation and would primarily depend on the dimension of the surrounding casing in which the tool 50 is to be used. As one example, the surrounding casing may be 5½" OD (17 lbs/ft) casing with a maximum inner bore dimension of about 4.976-in. and a minimum inner bore dimension of about 4.819-in. The tubular housing 52 for the tool 50 may be similar to 4½" OD (13.5 lbs/ft) flush joint tubing and may have an outer dimension of 4.227 to 4.232-in. In this context, the outer dimension of the tubular housing 52 can be about 90% of the inner dimension of the surrounding casing. It is expected that for this size of tubing as well as other sizes that the ratio of the housing's outer dimension to the casing's inner dimension can range from about 75 to 90%.

The split rings 60*a-c* on the housing 52 may have an uncollapsed dimension of about 5.05-in, essentially making them oversized to an extent relative to the casing's inner dimension. This leaves room for the split rings 60*a-c* to fit biased in the annular space between the tool's housing 52 and the casing. The split rings 60*a-c* may be collapsible to a drift diameter if necessary. Of course, the dimensions of the various components can be scaled for any particular implementation as needed.

Retainers 58*a-b*, spacers 58*c*, and the split rings 60*a-c* are disposed on the tubular housing 52. For example, the retainers 58*a-b* can be affixed toward the ends of the tubular housing 52 using conventional techniques (e.g., integrated shoulders, fasteners, threads, etc.) so that the split rings 60*a-c* and the intermediate spacers 58*c* can be held in place on the tubular housing 52. The retainers 58*a-b* can also help prevent the split rings 60*a-c* from extruding past them during use.

For their part, the spacers 58*c* and the split rings 60*a-c* may be allowed to move (i.e., rotate) on the tubular housing 52, which can facilitate assembly, deployment, and operation of the tool 50 downhole. Although the split rings 60*a-c* may be affixed at least partially on the housing 52, it is preferred that they are not secured directly to the housing 52 so they are able to expand and contract properly for the purposes disclosed herein. Finally, although the split rings 60*a-c* may be allowed to rotate on the housing 52, tabs or other features can be used to interlock or hold the split rings (60*a-c*) in a desired misaligned arrangement relative to one another so that the splits 62 are opposite each other or stay misaligned.

Figure 3A:
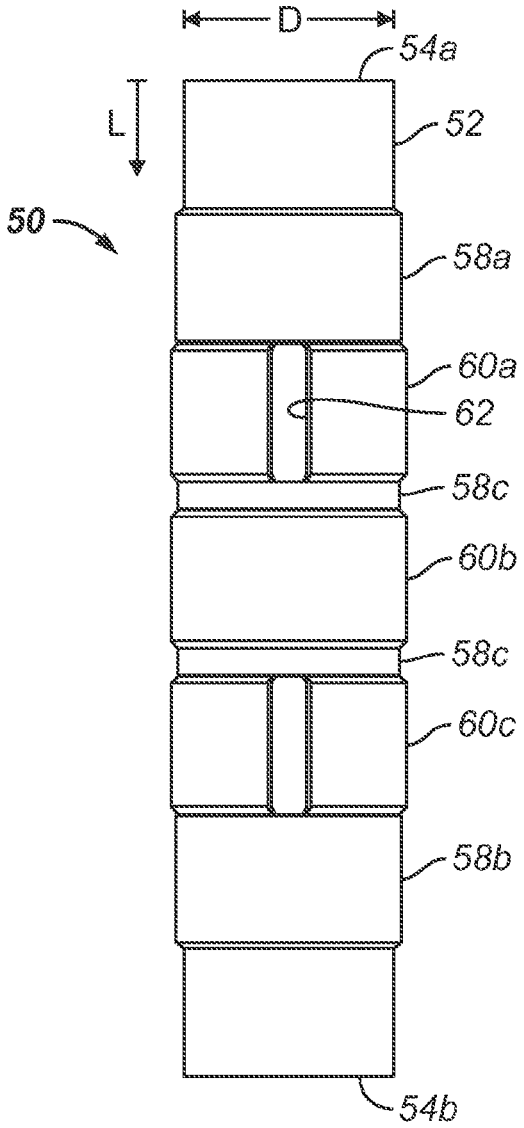
FIG. 3A illustrates an elevational view of one side of a re-fracture isolation tool for use in the wellbore system.
Figure 3B:
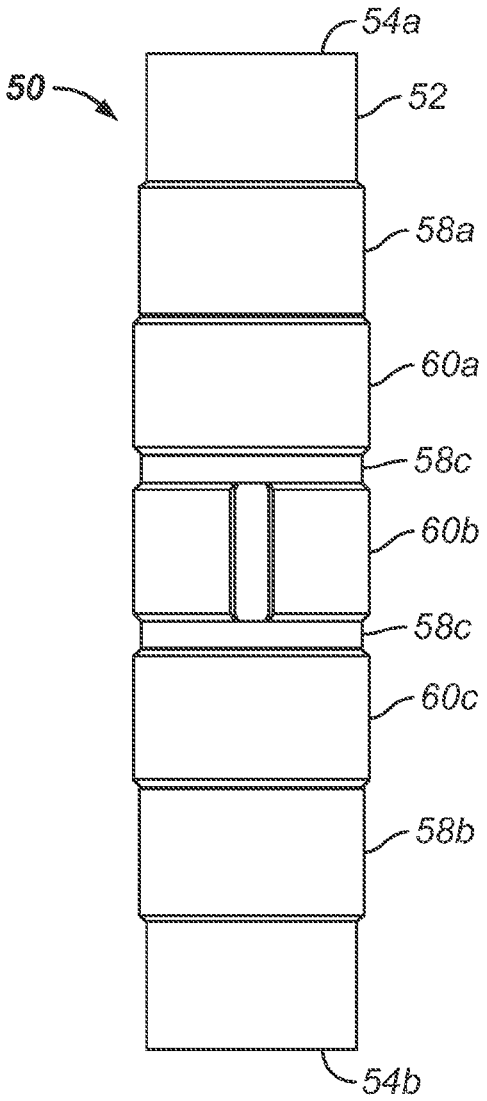
FIG. 3B illustrates an elevational view of another side of the re-fracture isolation tool.
Figure 3C:
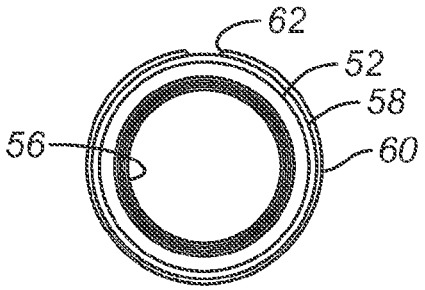
FIG. 3C illustrates an end view of the re-fracture isolation tool.
Figure 3D:
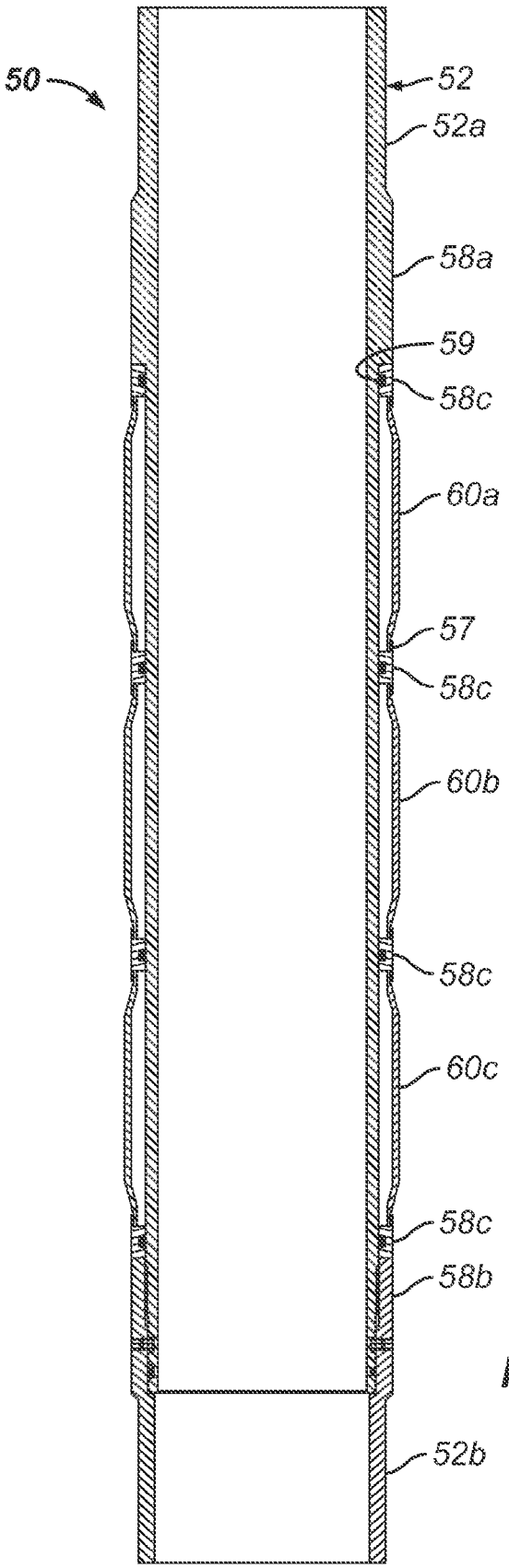
FIG. 3D illustrates a cross-sectional view of the re-fracture isolation tool.

As shown in FIG. 3D, one retainer 58*a* can be an integral part of a first housing portion 52*a*, and the other retainer 58*b* can be an integral part of a second housing portion 52*b* that affixes to the first housing portion 52*a* in a conventional manner. Additionally, the spacers 58*c* may have seals 59 (O-rings) on an inner diameter to engage the outside surface of the housing 52 and reduce leakage. The spacers 58*c* may also include lips or pockets 57 inside which the edges of the split rings 60*a-c* are retained.

The split rings 60*a-c* are C-rings having splits or end gaps 62 that allow the rings 60*a-c* to expand and contract relative to the outer dimension of the tubular housing 52. As illustrated in FIGS. 3A-3B, the split 62 is vertical, but other shapes can be used. For example, the split 62 may also include a 'Z' shaped separation of the ring 60*a-c* produced during manufacture. The outer dimension for the split rings 60*a-c* depends on the implementation and would primarily depend on the annular gap between the housing 52 and the surrounding casing in which the tool 50 is to be used. In general, the diameter of the split rings 60*a-c* is configured to engage the inner dimension of the surrounding casing in which the tool 50 is deployed to at least partially seal the annular gap.

As shown, the isolation tool 50 can have three split rings 60*a-c*, although more or less can be used depending on the treatment (e.g., fracture) pressures to be used, the flow rates expected, the casing and tubing sizes, and other factors. If possible, one split ring 60 could be used, but it is preferred that the number of split rings 60 is chosen to increase the surface area of potential engagement with the surrounding casing and to complicate the potential tortuous fluid path of any fluid flow past the tool 50 during treatment.

Generally speaking, the isolation tool 50 is not expected to make a perfect pressure seal during use. Instead, the series of expandable split rings 60*a-c* installed on the OD of the tubular housing 52 are naturally biased to expand outward to passively engage and contact the ID of the surrounding borehole or casing or open borehole. On a final note, the tubular housing 52, retainers 58*a-b*, and spacers 58*c* can be composed of suitable metal materials for downhole use. The split rings 60*a-c* can also be composed of a suitable metal material. Other materials can be used, such as a composite.

Computational Fluid Dynamics (CFD) modeling shows that the isolation tool 50 with the split rings 60*a-c* mounted on the tubular housing 52 can create a significant pressure drop between adjoining portions of the tubing string disposed in casing. As such, the isolation tool 50 can create adequate fluid isolation to an isolated zone being treated (e.g., fractured) in the wellbore (i.e., borehole or casing) during a treatment (e.g., re-fracture) operation. An increase in the number of split rings 60*a-c* allows for a higher pressure drop and more fluid diversion to be achieved.

Although described for use in re-fracture treatment, the isolation tool 50 can be used for any type of fluid treatment, such as diverting acid, steam, proppant, slurry, or other fluid treatment. Moreover, instead of re-fracture treatment, the isolation tool 50 can be used in a system for performing primary facture treatment in an open or cased hole.

Use of the disclosed isolation tool 50 produces contact in the ID of the wellbore (i.e., borehole or existing casing) and creates a tortuous fluid path for less bypass flow to pass the tool 50. The disclosed tool 50 allows close fitting tubulars to be used in the wellbore (i.e., borehole or casing) and enables high flow rates while providing a significant barrier against bypass flow.

Figure 4A:
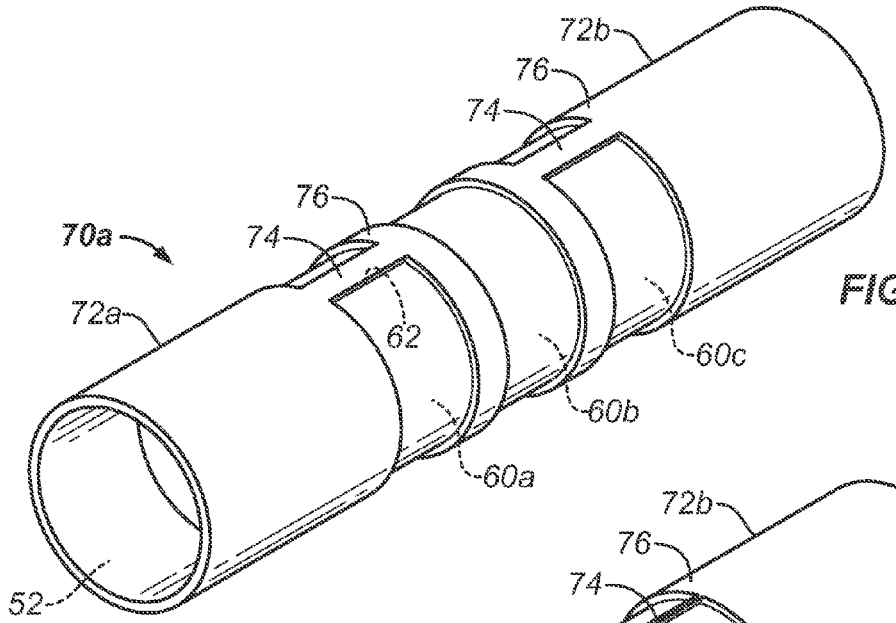
FIGS. 4A-4C conceptually illustrate the available flow area for the re-fracture isolation tool in three possible configurations for analyzing the fluid dynamics of flow around the tool.
Figure 4B:
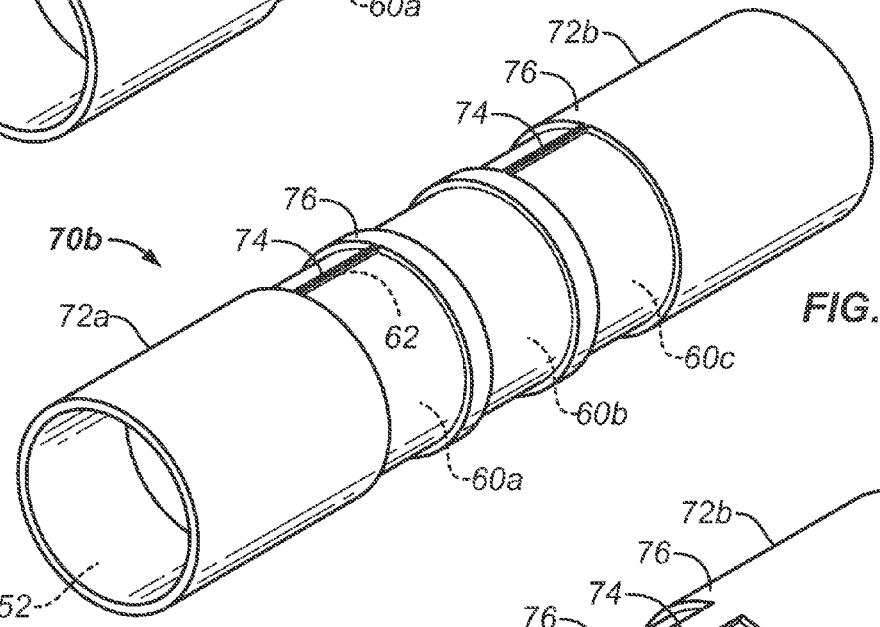
Figure 4C:
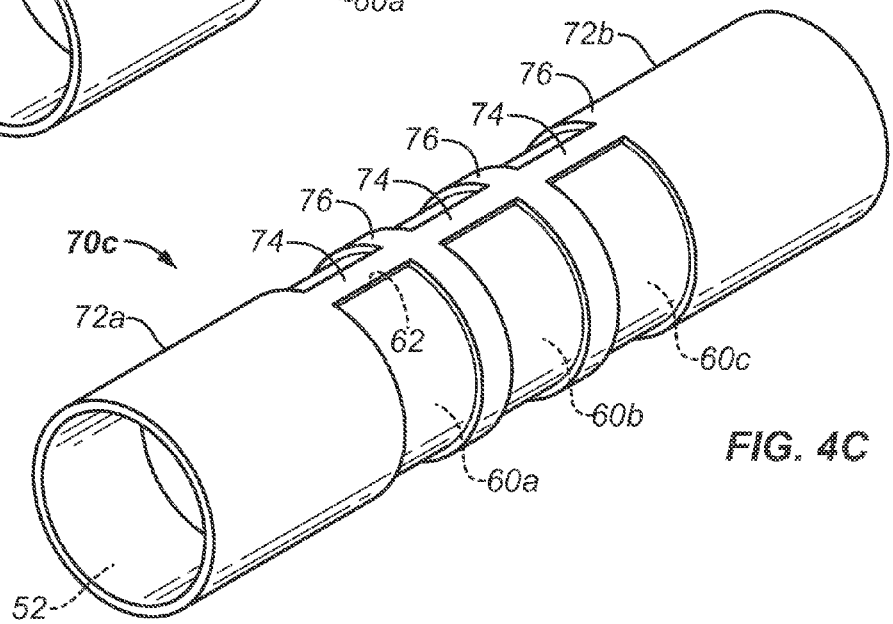

As noted above, Computational Fluid Dynamics (CFD) modeling shows that the isolation tool 50 can create a significant pressure drop between the tool 50 and surrounding casing. Turning to FIGS. 4A-4C, the available flow area 70*a-c* around the isolation tool (50) is conceptually illustrated in three possible configurations as positive spaces 72*a-b*, 74, and 76 relative to the components of the tool (50), which are not shown. Because the tool's split rings (60*a-c*) may be capable of rotating on the housing (52), the arrangement of the split rings (60*a-c*) can have a number of configurations relative to one another when disposed on the housing (52). In general, the arrangements break down to two general possibilities—arrangements where the splits (62) of two or more rings (60*a-c*) are not aligned and an arrangement where the splits (62) of all of the rings (60*a-c*) are aligned.

FIG. 4A shows the available flow area 70*a* for the tool (50) when the split rings (60*a-c*) have their splits (62) unaligned relative to one another. In particular, the splits (62) in the adjacent split rings (60*a-c*) are arranged at 180 degrees apart. FIG. 4B also shows the available flow area 70*b* for the diversion tool (50) when the split rings (60*a-c*) have their splits (62) arranged at 180 degrees apart. Here, however, the splits (62) in the split rings (60*a-c*) are narrower than in FIG. 4A, such as when smaller rings are used or the rings are more compressed. Finally, FIG. 4C shows the available flow area 70*c* for the diversion tool (50) when the split rings (60*a-c*) have their splits (62) aligned with one another.

In each configuration, the flow area 70*a-c* includes an inlet area 72*a* that would be uphole on the tool (50) in the casing and includes an outlet area 72*b* that would be downhole on the tool (50) in the casing. Accordingly, the inlet area 72*a* would be subjected to high pressures during treatment, such as a fracture pressure of as high as about 9000 psi. The outlet area 72*b*, however, would be expected to be at a significantly lower pressure. Any fluid in the annular inlet area 72 around the uphole end of the tool (50) would be able to flow past the first ring (60*a*) by flowing in the split area 74 of the first split ring (60*a*). Once past this first split ring (60*a*), the fluid in the intermediate annular area 76 would be able to flow past the second split ring (60*b*)

by flowing in the split area (not visible) of the second split ring (60*c*). Finally, once past this second split ring (60*b*), the fluid in the next intermediate annular area 76 would be able to flow past the third split ring (60*c*) to the outlet area 72*b* by flowing in the split area 74 of the third split ring (60*c*).

As can be seen, the flow in the areas 70*a-b* in FIGS. 4A-4B follows a tortuous fluid path due to the misaligned arrangement of the split rings (60*a-c*). Yet, the flow in the area 70*c* of FIG. 4C follows less of a tortuous fluid path. For each arrangement, these flow areas 70*a-c* were analyzed for water flow in CFD analyses to obtain corresponding fluid leakages past the split rings (60*a-c*) in these example configurations. For the purposes of the analysis, the water pressure at the inlet area 72*a* was set at 9000 psi, and the pressure at the outlet area 72*b* was set at zero gauge pressure. The water leakage rates through the three geometrical configurations of FIGS. 4A-4C were found to be 7.8 liters/s, 1.47 liters/s, and 13.33 liters/s, respectively, for the particular dimensions of the tool 50 under analysis.

These analysis results indicate that any possible flow past the isolation tool 50 may be acceptable for re-fracture treatment to be successful. In this sense, the pumping capacity used during the re-fracture treatment can be operated to exceed the leakage rate past the diversion tool 50. Additionally, the analysis results indicate that the isolation tool 50 can be configured to meet the requirements of a particular implementation, providing versatility in the design and use of the disclosed tool 50 in re-fracture treatments.

Figure 5:
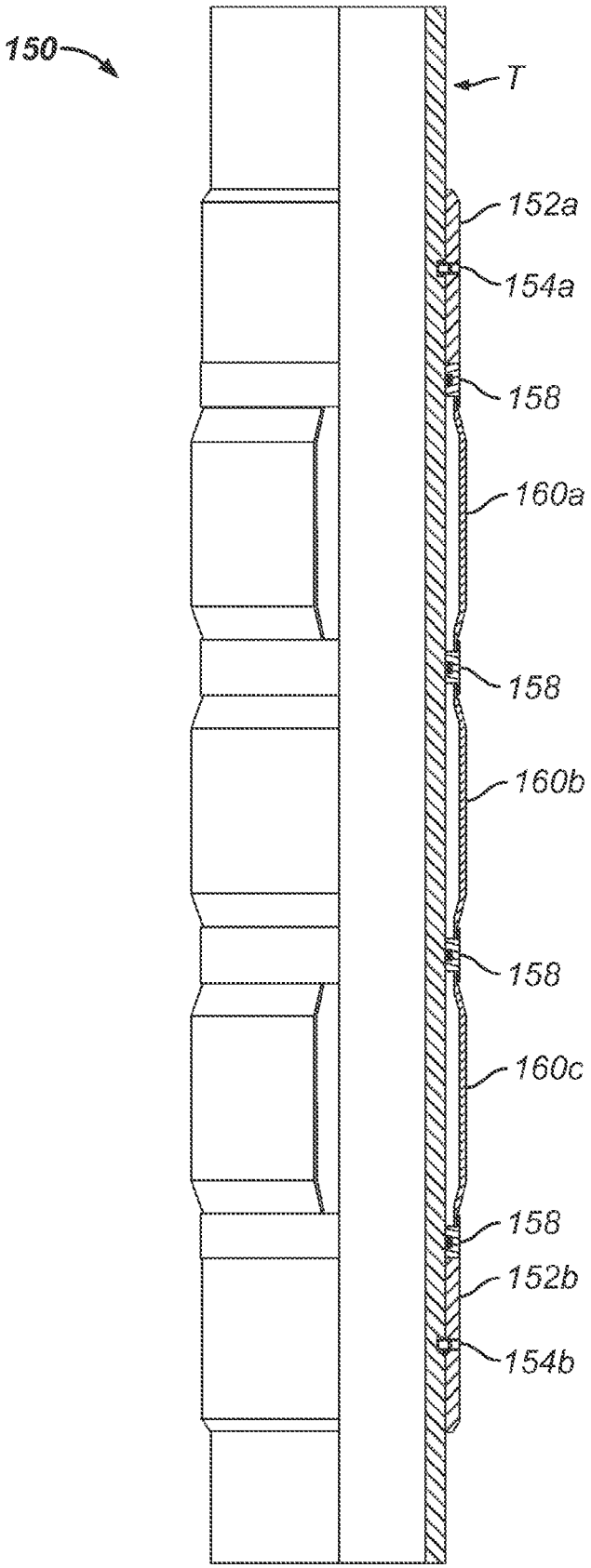
FIG. 5 illustrates an elevational view of one side of another isolation tool for use in the wellbore system.

In previous configurations, the isolation tool 50 has a housing 52 that couples to or is disposed on the tubing string. Alternative configurations can be used. For example, FIG. 5 illustrates an elevational view of one side of another isolation tool 150 for use in the wellbore system. In this configuration, the tool 150 uses an existing section of the tubing string or tubular T as the housing for the tool 150.

First and second retention shoulders 152*a-b* affix to the exterior of the tubular T. These retention shoulders 152*a-b* can be held in place on the tubular T in a number of ways, such as using fasteners 154*a-b*, welding, etc.

The configuration can use all of the same components and dimensions discussed previously. For example, the retentions shoulders 152*a-b* define the space for split rings 160*a-c*, retainers 158, etc. The tool 150 can be pre-constructed on the tubular T for the tubing string and then deployed with the stands of pipe during operations. Alternatively, the tool 150 with its elements can be installed on the tubing string section T during operations, although this may not be preferred.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of re-treating a formation having a wellbore, the method comprising:

deploying, in the wellbore, a tubing string having a plurality of tools disposed at intervals thereon, each of the tools having a plurality of biased split rings and a plurality of retentions rings disposed thereabout, at least two of the biased split rings on each of the tools having splits longitudinally misaligned with one another, opposing lips on at least one of the retention rings radially holding opposing edges of the biased split rings, the retention rings sealing an annular space between the retention rings and an outside of each of the tools;

passively engaging the biased split rings of each the tools with the wellbore;

accessing the annulus between the tubing string and the wellbore at the intervals between adjacent ones of the tools; and pumping retreatment into the formation by pumping the retreatment down the tubing string, out the access to the annulus in the intervals between the adjacent ones of the tools, and at least partially sealed in the intervals by the engaged split rings and by the sealed retention rings of the tools.

2. The method of claim 1, wherein deploying, in the wellbore, the tubing string having the plurality of tools disposed at the intervals thereon comprises positioning the tools on the tubing string by coupling a tool housing to sections of the tubing string.

3. The method of claim 1, wherein pumping the retreatment at least partially sealed in the intervals by the engaged split rings and by the sealed retention rings of the tools comprising creating a tortuous fluid path in the annulus between the longitudinally misaligned splits in the at least two biased split rings on each of the tools.

4. The method of claim 1, wherein passively engaging the biased rings of the tools with the wellbore comprises fixing the biased rings axially with shoulders on the tools.

5. The method of claim 1, wherein accessing the annulus between the tubing string and the wellbore at the intervals between the tools comprises opening sliding sleeves disposed on the tubing string at the intervals between the tools.

6. The method of claim 5, wherein opening the sliding sleeves disposed on the tubing string at the intervals between the tools comprises selectively opening one or more of the sliding sleeves at a time prior to pumping the retreatment into the formation.

7. The method of claim 1, wherein accessing the annulus between the tubing string and the wellbore at the intervals between the tools comprises perforating the tubing string at the intervals between the tools.

8. The method of claim 7, wherein perforating the tubing string at the intervals between the tools comprises successively perforating along the tubing string at each of the intervals.

9. The method of claim 1, wherein pumping the retreatment at least partially sealed in the intervals by the engaged split rings of the tools comprising pumping with a capacity exceeding a leakage rate past the splits in the engaged split rings of the adjacent one of the tools.

10. The method of claim 1, wherein passively engaging the biased rings of the tools with the wellbore comprises providing the rings with an unbiased diameter at least greater than an inner dimension of the wellbore.

11. The method of claim 1, wherein pumping the retreatment into the formation comprises pumping a fluid treatment selected from the group consisting of acid, steam, fracture fluid, proppant, and slurry.

12. A tool for a retreatment of a formation having a wellbore using a tubing string, the tool comprising:

a housing positioning on the tubing string; and a plurality of split rings disposed adjacent one another about the housing and biased outward, at least two of the biased split rings having splits longitudinally misaligned with one another, the split rings passively engageable with the wellbore and at least partially sealing intervals of the annulus between the tubing string and the wellbore above and below the split rings; and retention rings disposed about the housing and opposing lips on at least one of the retention rings radially holding opposing edges of the adjacent split rings.

13. The tool of claim 12, wherein the housing comprises first and second ends coupling to sections of the tubing string.

14. The tool of claim 12, wherein the longitudinally misaligned splits in the at least two biased split rings define a tortuous fluid path in the annulus.

15. The tool of claim 12, wherein the split rings comprise an unbiased diameter at least greater than an inner dimension of the wellbore.

16. The tool of claim 12, wherein the retention rings comprise seals disposed on an inner surface thereof for sealing against the outer surface of the housing.

17. The tool of claim 12, wherein the housing defines upper and lower shoulders on an exterior thereof and restricting axial movement of the rings along a length of the housing.

18. The tool of claim 12, wherein the split rings comprise a metallic material.

19. The tool of claim 12, wherein the split rings define beveled edges permitting sliding engagement of the rings in and out of the wellbore.

20. An apparatus for a retreatment of a formation having a wellbore, the apparatus comprising:

one or more tubulars for deploying in the wellbore adjacent the formation;

retention shoulders positioning on the one or more tubulars; and a plurality of split rings positioned together at a plurality of intervals about the one or more tubulars between the retention shoulders and being biased outward, at least two of the biased split rings positioned together at each of the intervals having splits longitudinally misaligned with one another, the split rings passively engageable with the wellbore and at least partially sealing intervals of the annulus between the tubing string and the wellbore above and below the split rings; and retention rings disposed about the housing and sealing an annular space between the retention rings and an outer surface of the housing, opposing lips on at least one of the retention rings radially holding opposing edges of the adjacent split rings.

21. The apparatus of claim 20, wherein the one or more tubulars comprise an increased external dimension relative to the internal dimension of the wellbore, whereby the annulus formed therebetween is narrow.

* * * * *